US008256171B2

(12) United States Patent
Yeremian

(10) Patent No.: US 8,256,171 B2
(45) **Date of Patent: *Sep. 4, 2012**

(54) EXPANDABLE DOOR FRAME, KIT, AND METHOD OF INSTALLATION

(76) Inventor: Noubar Yeremian, Radnor, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/030,681

(22) Filed: Feb. 18, 2011

(65) Prior Publication Data

US 2011/0138718 A1 Jun. 16, 2011

Related U.S. Application Data

(63) Continuation of application No. 12/235,480, filed on Sep. 22, 2008, now Pat. No. 7,913,465.

(60) Provisional application No. 60/974,348, filed on Sep. 21, 2007.

(51) Int. Cl.
*E06B 3/988* (2006.01)

(52) U.S. Cl. ... 52/204.72; 52/204.1; 52/217; 52/204.53; 52/204.56; 52/215

(58) Field of Classification Search ..... 52/204.1, 52/204.2, 206, 211, 212, 213, 215, 204.53, 52/204.54, 204.55, 204.56, 204.57, 217, 52/204.72; 49/504, 505
See application file for complete search history.

(56) References Cited

U.S. PATENT DOCUMENTS

| | | | | | |
|---|---|---|---|---|---|
| 1,150,790 | A * | 8/1915 | Swanson | 52/211 |
| 2,595,506 | A * | 5/1952 | Backman | 52/127.12 |
| 3,570,203 | A * | 3/1971 | Williams | 52/217 |
| 3,812,621 | A * | 5/1974 | Ragland | 49/505 |
| 4,453,346 | A * | 6/1984 | Powell et al. | 49/404 |
| 4,698,944 | A * | 10/1987 | Wilkins, Jr. | 52/211 |
| 4,873,804 | A * | 10/1989 | Kukke | 52/217 |
| 4,894,955 | A * | 1/1990 | Metz | 49/504 |
| 4,921,382 | A * | 5/1990 | Fries et al. | 411/45 |
| 5,187,898 | A * | 2/1993 | McKann | 49/505 |
| 6,167,663 | B1 * | 1/2001 | Nakamoto et al. | 52/217 |
| 7,913,465 | B2 * | 3/2011 | Yeremian | 52/204.7 |

* cited by examiner

*Primary Examiner* — William Gilbert
*Assistant Examiner* — Chi Nguyen
(74) *Attorney, Agent, or Firm* — RatnerPrestia

(57) ABSTRACT

An expandable frame for a storm door mounted onto the header and door jamb in an entrance, a frame kit, and method of installation. The expandable frame includes an expandable header assembly, an expandable lock-side assembly and a hinge-side piece. The header assembly includes a frame mount and a header stop mounted onto the underside of the header, the hinge-side piece is mounted vertically against the door jamb on one side of the entry, and the lock-side assembly includes a lock-side stop and a frame mount mounted vertically onto the door jamb opposite the hinge section. A user can adjust the position of the header assembly and lock-side assembly to accommodate a door having smaller dimensions than the height and width of the entrance.

14 Claims, 6 Drawing Sheets

TYPICAL EXISTING ADJUSTABLE STORM DOORS ON MARKET

EXPANDABLE DOOR FRAME, KIT, AND METHOD OF INSTALLATION

PRIOR APPLICATIONS

This application claims priority of U.S. Utility application Ser. No. 12/235,480 filed Sep. 22, 2008 which claims priority of U.S. Provisional Application 60/974,348 filed Sep. 21, 2007. Both applications are incorporated herein by reference in their entirety.

FIELD OF THE INVENTION

The present invention relates generally to the field of door frames. More specifically the present invention relates to a frame, its kit, and a method for installing an expandable door frame for conventional storm doors within the opening bounded by a door jamb and a header.

SUMMARY OF THE INVENTION

The present invention is an expandable frame for a storm door. The frame is mounted onto the header and door jamb in an entrance. The expandable feature of the frame eliminates the need to affix U-shaped brackets along the sides of a storm door when the storm door is smaller than the height or width of the entry. The frame includes an expandable header assembly, an expandable lock-side assembly and a hinge-side piece. The header assembly includes a frame mount and a header stop. The frame mount is mounted onto the underside of an entry-way header and the header stop is then attached to the frame mount. The separation between the frame mount and the header stop is adjustable. The hinge-side piece is mounted vertically along a door jamb on one side of the entrance. The lock-side assembly includes a lock-side stop and a frame mount. The frame mount for the lock-side assembly is mounted vertically onto a door jamb generally parallel to the hinge-side piece. The lock-side stop is then attached to the frame mount. The lock-side assembly, like the header assembly, is adjustable.

It is an aspect of the present invention to provide an expandable frame and its kit that is easily installed in an entrance and adjusted, so that the dimensions of the entry will accommodate a storm door.

It is another aspect of the present invention to provide a method of installing an expandable frame assembly that will allow the user to adjust the dimensions of the opening in an entry to accommodate a storm door having smaller dimensions than the height and width of the opening.

It is yet another aspect of the present invention to provide an expandable door frame having the advantageous characteristics mentioned above, which is simple in structure and economical in manufacture, and staunch, durable and reliable to effectively provide an adequate frame around the entry of a storm door.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
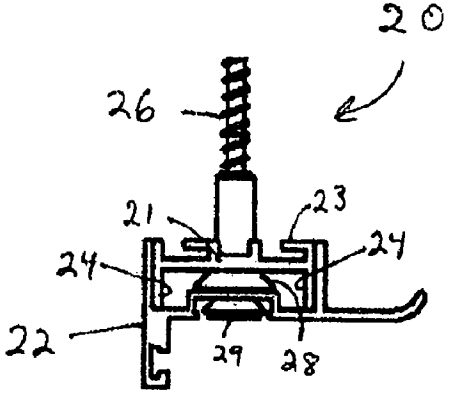
FIG. 1 is a left-side elevational view of the header assembly of the expandable frame of the present invention as viewed along line I-I in FIG. 9.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

The expandable door frame of the present invention includes a header assembly 20, a hinge-side piece 45, and a lock-side assembly 60. The expandable door frame may be made of any material suitable to support a door within an entrance, depending on the location, weight, and type of door.

Figure 2:
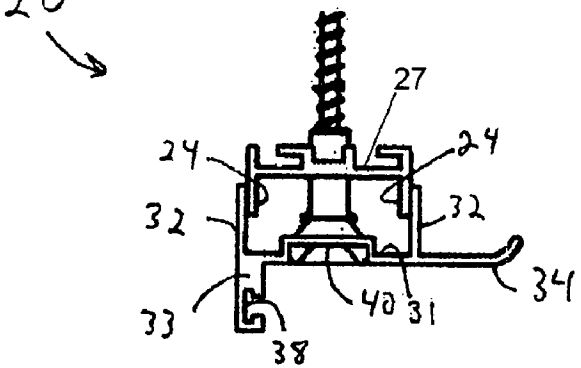
FIG. 2 is a left-side elevational view of the header assembly of the expandable frame of the present invention as viewed along line II-II in FIG. 10.

FIGS. 1 and 2 depict a header assembly 20. The header assembly 20 comprises a frame mount 21 and a header stop 22. The frame mount 21 has a bottom surface 23 integrally connected to two generally parallel side walls 24 that are generally perpendicular to the bottom surface 23. The frame mount 21 is mounted onto the header of an entrance, such that the bottom surface 23 is generally flush with the underside of the header. The frame mount 21 preferably has at least one mounting hole 25 in which a mounting screw 26 is inserted to attach the frame mount 21 to the underside of the header. The bottom surface 23 of the frame mount 21 is optionally shaped to include at least one groove 27. The grooved bottom surface reduces the amount of material needed to construct the frame mount without depriving the frame mount of the strength and rigidity needed to support the header stop. The frame mount 21 also includes additional holes to receive an adjustment screw 28 and a locking screw 29.

Upon mounting the frame mount 21 onto the underside of the header, an adjustment screw 28 is inserted through the adjustment screw hole 30 in the frame mount 21 and into the header. The header stop 22 is then mounted onto the frame mount 21. The header stop 22 includes a top surface 31 integrally connected to two generally parallel expander walls 32, a door stop 33, and a lip 34. When the header stop 22 is mounted onto the frame mount 21, the two parallel side walls 24 of the frame mount 21 are in sliding contact with the two parallel expander walls 32 of the header stop 22, the lip 34 extends in a direction generally perpendicular to the expander walls 32, and the top surface 31 of the header stop 22 rests against the head of the adjustment screw 28. The header stop 22 includes an adjustment screw hole 35 in registry with the adjustment screw 28 and a locking screw hole 36 in registry with the locking screw hole 37 in the frame mount 21. The head of the adjustment screw 28 is larger than the diameter of the adjustment screw hole 35 which enables the header stop 22 to rest on the head of the adjustment screw 28.

The header assembly 20 expands between a closed position depicted in FIG. 1 and an open position depicted in FIG. 2. The distance between the top surface 31 of the header stop 22 and the bottom surface 23 of the frame mount 21 depends on the depth in which the adjustment screw 28 is inserted into the header. In FIG. 1, the adjustment screw 28 is inserted into the header to a depth that allows the top surface 31 of the header stop 22 to contact the two parallel side walls 24 of the frame mount 21. In FIG. 2, the adjustment screw 28 has not penetrated the header as deep as the adjustment screw depicted in FIG. 1, thus the header assembly 20 is expanded to the open position because the top surface 31 of the header stop 22 rests on the head of the adjustment screw 28. The adjustment screw hole 35 in the header stop 22 provides access to the adjustment screw 28 to vary the depth of the adjustment screw 28 in the header. When a user has selected the appropriate depth for the adjustment screw, the header stop 22 is locked in place by inserting a locking screw 29 through the locking screw holes 36, 37 in the header stop 22 and the frame mount 21.

Figure 12:
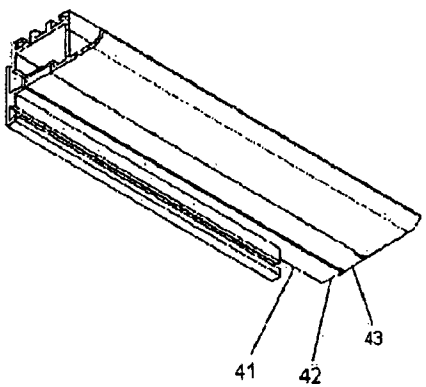
FIG. 12 is a fragmentary bottom perspective view of the expandable frame of the present invention showing the header assembly in the open position.
Figure 11:
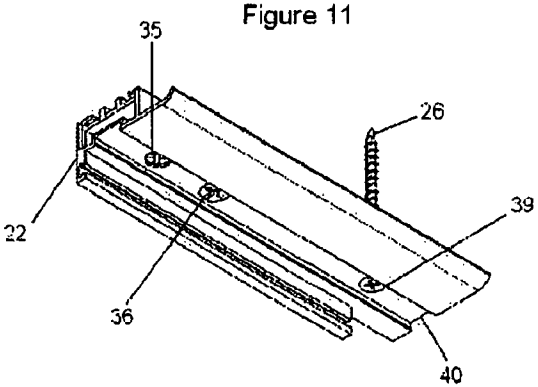
FIG. 11 is a fragmentary bottom perspective view of the expandable frame of the present invention showing the header assembly in the closed position.
Figure 13:
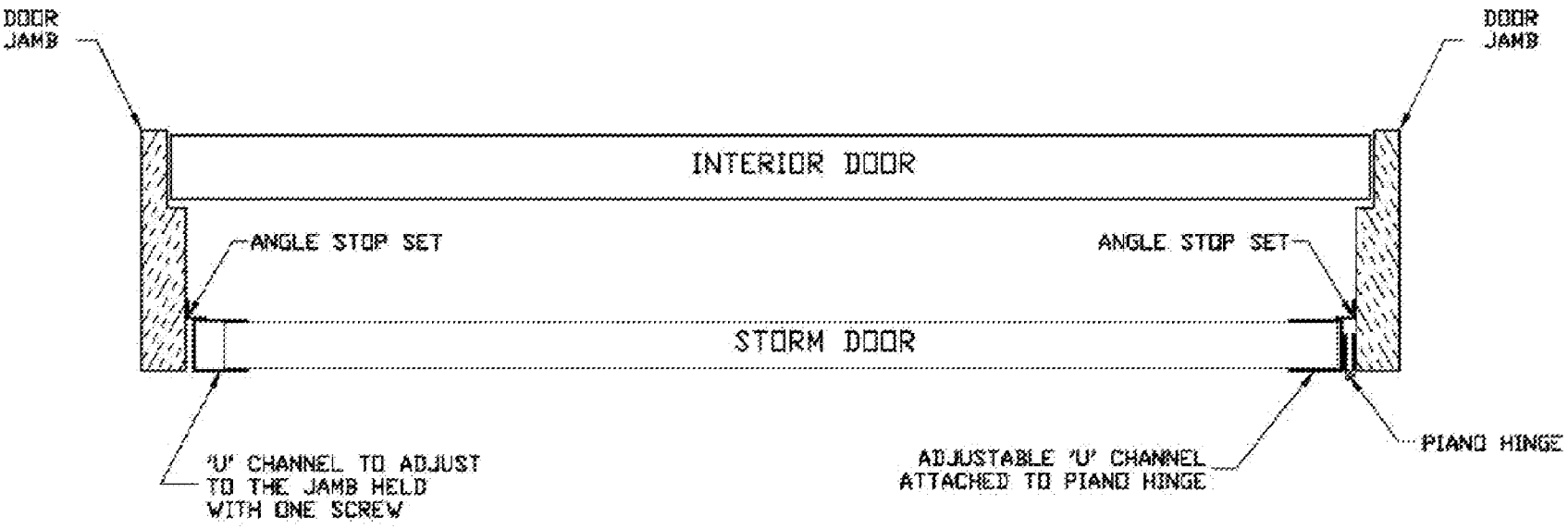
FIG. 13 is a plan view of a prior art U-bracket system
Figure 15:
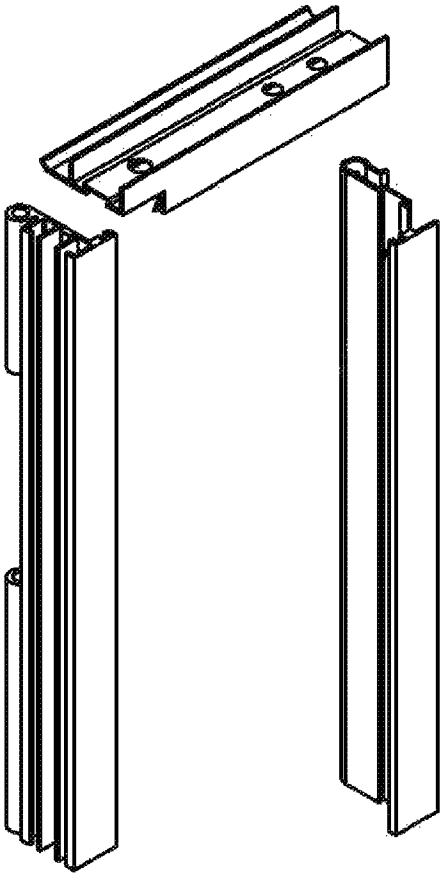
FIG. 15 is a perspective view of the header-stop, lock-side stop, and hinge-side piece of the present invention as seen from the inside of a house
Figure 14:
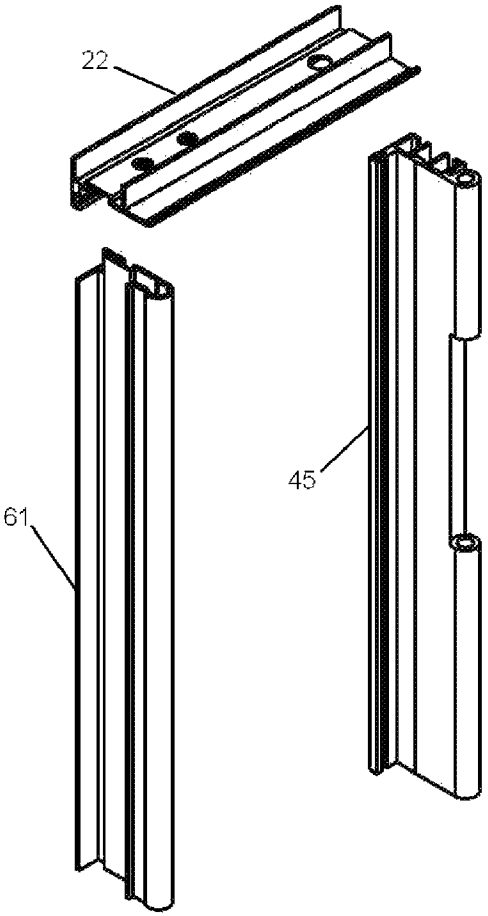
FIG. 14 is a perspective view of the header-stop, lock-side stop, and hinge-side piece of the present invention as seen from the outside of a house

The door stop 33 of the header stop 22 optionally includes a weather stripping groove 38. The header stop 22 also includes a lip 34 that shields water or other elements from entering the top of a storm door. The depth of the adjustment screw 28 should be set so that the header assembly 20 has expanded to a position that allows a storm door to pass under the lip 34 and contact the door stop 33 when closed. The header stop 22 optionally includes a clearance hole 39 in registry with the mounting screws 26 for the frame mount 21 to provide quick access to the mounting screws 26 without having to remove the header stop 22. The header stop 22 also optionally includes a cover groove 40 in which the adjustment screw holes 35, locking screw holes 37, and clearance holes 39 reside. The cover groove 40 accepts a cover 43, as shown in FIG. 12, in order to conceal the various screws inserted in each hole and provide a more aesthetically pleasing look for the header assembly 20 when installed. The header assembly 20 may optionally include a notch 41 created by removing a section of the door stop 33, so that the bottom surface 42 of the header stop 22 can rest on the hinge-side piece 45.

Figure 6:
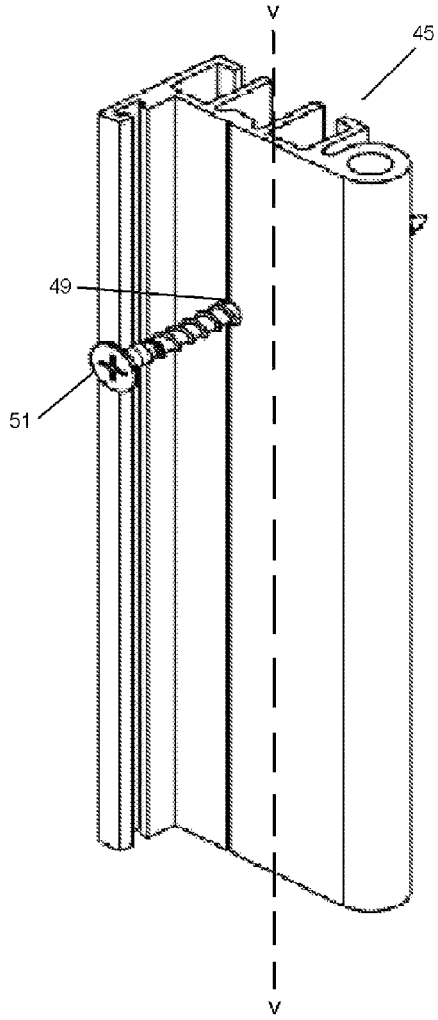
FIG. 6 is a fragmentary perspective view of the expandable frame of the present invention showing the hinge-side piece.
Figure 5:
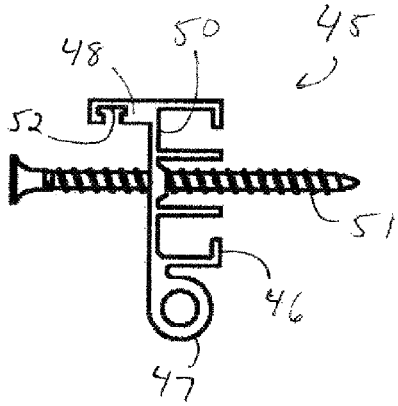
FIG. 5 is a view from above the hinge-side piece of the expandable frame of the present invention as viewed along line V-V in FIG. 6.
Figure 7:
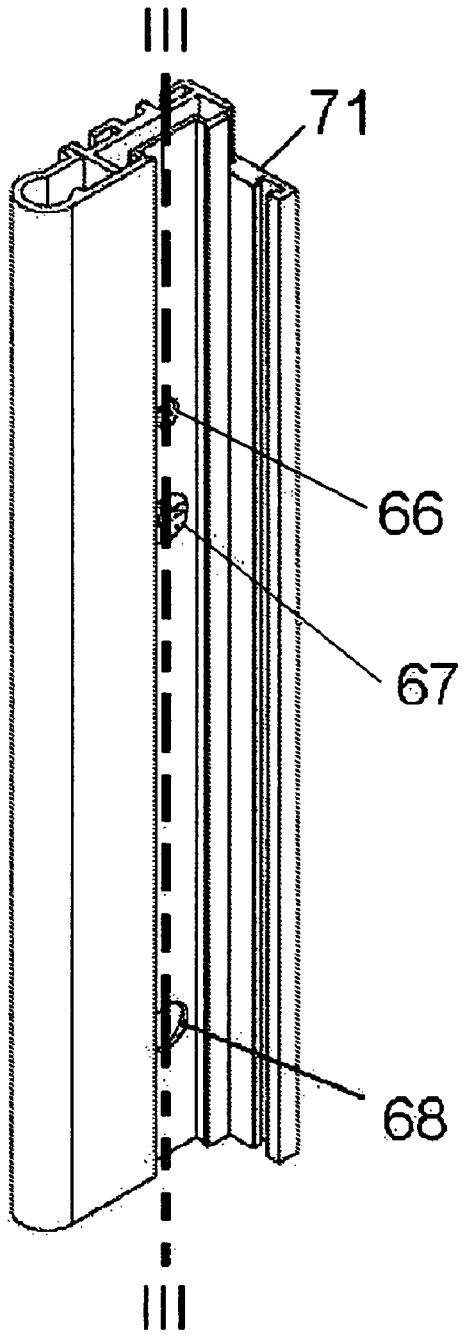
FIG. 7 is a fragmentary perspective view of the expandable frame of the present invention showing the lock-side assembly in the closed position.
Figure 8:
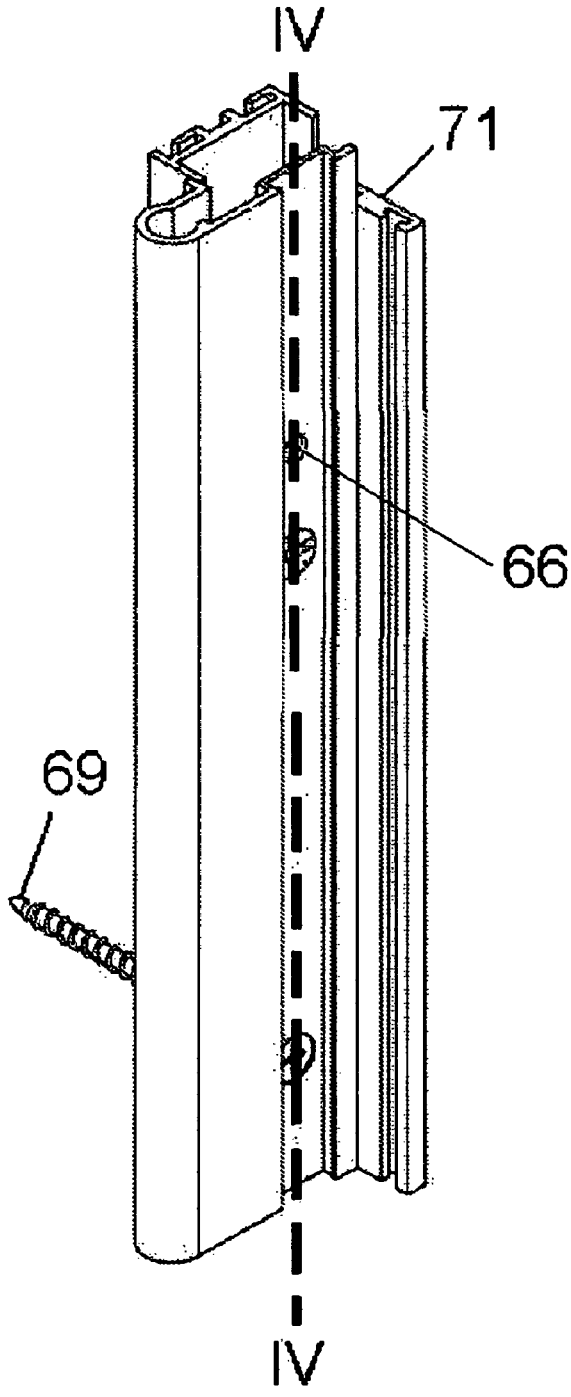
FIG. 8 is a fragmentary perspective view of the expandable frame of the present invention showing the lock-side assembly in the open position.
Figure 10:
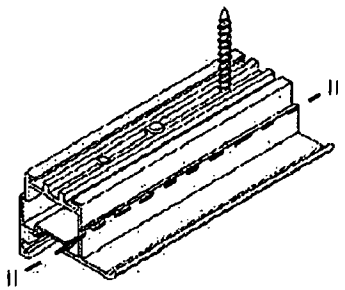
FIG. 10 is a fragmentary top perspective view of the expandable frame of the present invention showing the header assembly in the open position.
Figure 9B:
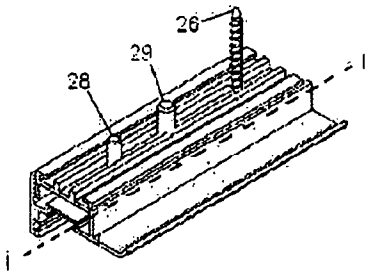
FIGS. 9*a* and 9*b* are fragmentary top perspective views of the expandable frame of the present invention showing the header assembly in the closed position.
Figure 9A:
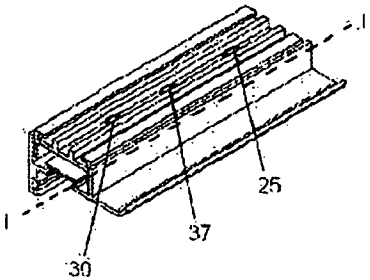

Referring now to FIGS. 5 and 6, the hinge-side piece 45 comprises a mounting surface 46, a hinge section 47, and a door stop 48. The hinge-side piece 45 is mounted vertically onto a door jamb of an entrance on the side of the entrance that coincides with the hinge on a door that is mounted on the door frame. The hinge-side piece 45 is mounted so that the mounting surface 46 is generally flush with the door jamb and preferably has at least one mounting hole 49 in which a mounting screw 51 is inserted to attach the hinge-side piece 45 to the door jamb. The mounting surface 46 of the hinge-side piece 45 is optionally shaped to include at least one groove 50. The grooved surface reduces the amount of material needed to construct the hinge-side piece without depriving the hinge-side piece of the strength and rigidity needed to support a door.

Unlike the header assembly 20 and the lock-side assembly 60, the hinge-side piece 45 is not adjustable. The hinge-side piece 45 includes a hinge section 47 that can receive a pin, such as a pin inserted into a piano hinge, which are typically used to mount storm doors. The door stop 48 for the hinge-side piece 45 also optionally includes a weather stripping groove 52.

Figure 3:
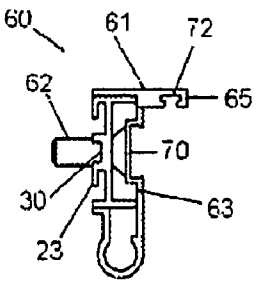
FIG. 3 is a view from above the lock-side assembly of the expandable frame of the present invention as viewed along line III-III in FIG. 7.
Figure 4:
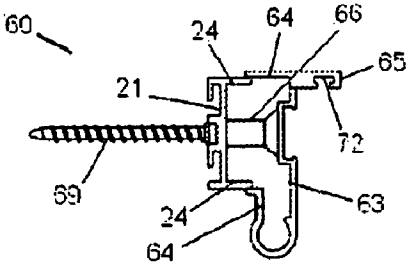
FIG. 4 is a view from above the lock-side assembly of the expandable frame of the present invention as viewed along line IV-IV in FIG. 8.

FIGS. 3 and 4 demonstrate a sectional view of the lock-side assembly 60. The lock-side assembly 60 comprises a frame mount 21, similar to the header assembly 20, and a lock-side stop 61. The frame mount 21 is similar to the frame mount 21 for the header assembly 20, except that the lock-side assembly 60 is mounted vertically on the door jamb, generally parallel to the hinge-side piece 45 on the opposite side of the entrance. This side of the entrance coincides with the lock-side of a door that is mounted on the door frame. The bottom surface 23 of the frame mount 21 for the lock-side assembly 60 is mounted generally flush with the surface of the door jamb. The frame mount 21 preferably has at least one mounting hole 25 in which a mounting screw 26 is inserted to attach the frame mount 21 to the door jamb.

Similar to the header assembly, upon mounting the frame mount 21 onto the door jamb, an adjustment screw 62 is inserted through an adjustment screw hole 30 in the frame mount 21 and into the door jamb. The lock-side stop 61 is then mounted onto the frame mount 21. The lock-side stop 61 includes a top surface 63 integrally connected to two expander walls 64, and a door stop 65. One of the expander walls 64 can be optionally curved to resemble the hinge section 47 of the hinge-side piece 45 to provide a more symmetrical and aesthetically pleasing look to the door frame when installed.

When the lock-side stop 61 is mounted onto the frame mount 21, the two side walls 24 of the frame mount 21 are in sliding contact with the two expander walls 64 of the lock-side stop 61, and the top surface 63 of the lock-side stop 61 rests against the head of the adjustment screw 62. The lock-side stop 61 includes an adjustment screw hole 66 in registry with the adjustment screw 62 and a locking screw hole 67 in registry with the locking screw hole 37 in the frame mount 21. The head of the adjustment screw 62 is larger than the diameter of the adjustment screw hole 66 which enables the lock-side stop 61 to rest on the head of the adjustment screw 62.

The lock-side assembly 60 expands between a closed position depicted in FIG. 3 and an open position depicted in FIG. 4. The distance between the top surface 63 of the lock-side stop 61 and the bottom surface 23 of the frame mount 21 depends on the depth in which the adjustment screw 62 is inserted into the door jamb. In FIG. 3, the adjustment screw is inserted into the door jamb, such that the top surface 63 of the lock-side stop 61 is in contact with the two parallel side walls 24 of the frame mount 21. In FIG. 4, the adjustment screw 62 has not penetrated the door jamb as deeply as the adjustment screw depicted in FIG. 3, thus the lock-side assembly 60 has expanded to the open position because the top surface 63 of the lock-side stop 61 rests on the head of the adjustment screw 62. The adjustment screw hole 66 in the lock-side stop 61 provides access to the adjustment screw 62 to vary the depth of the adjustment screw 62 in the door jamb. When a user has selected the appropriate depth for the adjustment screw 62, the lock-side stop 61 is locked in place by inserting a locking screw through the locking screw holes 67, 37 in the lock-side stop 61 and the frame mount 21.

The door stop 65 of the lock-side stop 61 optionally includes a weather stripping groove 72. The lock-side stop 61 optionally includes a clearance hole 68 in registry with the mounting screws 69 for the frame mount 21 to provide quick access to the mounting screws 69 without having to remove the lock-side stop 61. The lock-side stop 61 also optionally includes a cover groove 70 in which the adjustment holes 66, locking holes 67, and clearance holes 68 reside. The cover groove 70 accepts a cover in order to conceal the various screws and provide a more aesthetically pleasing look for the lock-side assembly 60 when installed. The lock-side assembly 60 optionally includes a notch 71 created by removing a section of the door stop 65, so that the lip 34 and door stop 33 of the header stop 22 can rest on the lock-side assembly 60.

While preferred embodiments of the invention have been disclosed and described in detail, it is to be understood that the invention is not so limited, but rather it is intended to include all embodiments which would be apparent to one skilled in the art and which come within the spirit and scope of the invention.

I claim:

1. A door frame assembly capable of being mounted in the entry of a doorway comprising:

a bottom portion having at least one side wall extending from said bottom portion and a plurality of holes, wherein said plurality of holes includes at least one adjustment screw hole and a first locking screw hole;

a top portion having a second locking screw hole and at least one expander wall extending from said top portion, said top portion capable of being mounted on said bottom portion, such that said at least one side wall and at least one expander wall overlap when assembled;

an adjustment screw inserted in said bottom portion through said adjustment screw hole, said adjustment screw having a head between said top portion and said bottom portion and said head being a variable distance from said bottom portion when assembled; and a locking screw inserted through the second locking screw hole of said top portion and through the first locking screw hole of said bottom portion, wherein said locking screw contacts said top portion to force said top portion against said head when assembled; and wherein said adjustment screw and said locking screw are not inserted through the same hole in said bottom portion.

2. The door frame assembly of claim 1, further comprising a door stop extending from said top portion in a direction opposite from said at least one expander wall.

3. The door frame assembly of claim 2, wherein said top portion includes a lip extending in a direction that is generally perpendicular to said door stop.

4. The door frame assembly of claim 1, wherein said top portion includes a cover groove through which said locking screw is inserted.

5. The door frame assembly of claim 4, further comprising a cover capable of being installed in said cover groove.

6. The door frame assembly of claim 1, wherein said top portion includes an access hole in registry with said head of said adjustment screw.

7. The door frame assembly of claim 6, wherein said top portion includes a cover groove in which said access hole is located.

8. The door frame assembly of claim 7, further comprising a cover capable of being installed in said cover groove.

9. The door frame assembly of claim 1, wherein at least one of said bottom portion and top portion includes grooves having dimensions that minimize the amount of material needed to construct said top portion or said bottom portion while maintaining a pre-determined minimum value of strength and rigidity.

10. The door frame assembly of claim 1 further comprising a hinge-side piece installed in the entry either perpendicular or parallel to said bottom portion, said hinge side piece having a knuckled section capable of receiving a door hinge pin.

11. A door frame kit capable of being installed in the boundary of an entrance, that boundary including a generally horizontal entrance header and generally vertical door jambs, the door frame kit comprising a first door frame assembly of claim 1 installed on the entrance header and a second door assembly of claim 1 installed on one of the vertical door jambs.

12. The door frame kit of claim 11, further comprising a hinge-side piece installed on one of the vertical door jambs unoccupied by said second door frame assembly.

13. The door frame kit of claim 12, wherein said hinge-side piece has a knuckled section capable of receiving a door hinge pin.

14. The door frame kit of claim 13, wherein said at least one expander wall of said top portion of said second door frame assembly is shaped to resemble said knuckled section of said hinge-side piece.

* * * * *